US011131043B2

(12) United States Patent
Zhang et al.

(10) Patent No.: US 11,131,043 B2
(45) Date of Patent: Sep. 28, 2021

(54) METHOD OF MANUFACTURING AND APPLICATION OF BODY SMOOTHING KNITTED UNDERWEAR CAPABLE OF BEING USED AS OUTERWEAR

(71) Applicant: Ziyang Zhang, Shenzhen (CN)

(72) Inventors: Ziyang Zhang, Shenzhen (CN); Michael Joseph Coyle, Strabane (GB)

(73) Assignee: Ziyang Zhang, Shenzhen (CN)

( * ) Notice: Subject to any disclaimer, the term of this patent is extended or adjusted under 35 U.S.C. 154(b) by 418 days.

(21) Appl. No.: 16/265,999

(22) Filed: Feb. 2, 2019

(65) Prior Publication Data

US 2020/0181815 A1 Jun. 11, 2020

(30) Foreign Application Priority Data

Dec. 10, 2018 (CN) ..... 201811503483.1

(51) Int. Cl.
*D04B 1/26* (2006.01)
*A41B 11/14* (2006.01)
(Continued)

(52) U.S. Cl.
CPC ..... *D04B 1/26* (2013.01); *A41B 11/14* (2013.01); *A41C 5/00* (2013.01); *D04B 1/16* (2013.01); *D04B 1/18* (2013.01); *A41B 9/06* (2013.01); *A41B 9/08* (2013.01); *A41B 2400/38* (2013.01); *A41B 2500/10* (2013.01); *A41B 2500/50* (2013.01); *D10B 2201/02* (2013.01); *D10B 2211/02* (2013.01); *D10B 2331/02* (2013.01);
(Continued)

(58) Field of Classification Search
CPC .... D04B 1/26; D04B 1/16; D04B 1/18; A41B 11/14; A41B 9/06; A41B 9/08; A41B 2400/38; A41B 2500/10; A41B 2500/50; A41B 17/00; A41C 5/00; A41C 1/00; D10B 2201/02; D10B 2211/02; D10B 2331/02; D10B 2331/10; D10B 2401/13; D10B 2401/16; D10B 2501/02; D10B 2501/021; D10B 2501/04; A41H 43/00; A41D 31/18
USPC ..... 28/154
See application file for complete search history.

(56) References Cited

U.S. PATENT DOCUMENTS 7,842,628 B2 * 11/2010 Yasui ..... A41D 31/00 442/197
2003/0056553 A1 * 3/2003 Yamazaki ..... D04B 1/24 66/171

FOREIGN PATENT DOCUMENTS

CN 106263100 B * 10/2017

OTHER PUBLICATIONS

English translation of CN106263100, Oct. 13, 2017.*

* cited by examiner

*Primary Examiner* — Nathan E Durham
*Assistant Examiner* — Abby M Spatz
(74) *Attorney, Agent, or Firm* — Bayramoglu Law Offices LLC

(57) ABSTRACT

The present invention provides a method of manufacturing and an application of body smoothing knitted underwear capable of being used as an outerwear. The method includes the following steps: raw material preparation, knitting, dyeing, setting, cutting and sewing, bonding, ironing and finishing. The method can be realized by using the existing combined cylinder knitting device. Through the innovation of raw materials and processes, the underwear produced is soft, comfortable, breathable and warm, and has modest elasticity and the body smoothing function, which can
(Continued)

tighten the skin. It is beautiful and elegant, and suitable for outside wearing as well.

3 Claims, 2 Drawing Sheets

(51) Int. Cl.

| | |
|---|---|
| ***A41C 5/00*** | (2006.01) |
| ***D04B 1/16*** | (2006.01) |
| ***D04B 1/18*** | (2006.01) |
| ***A41B 9/06*** | (2006.01) |
| ***A41B 9/08*** | (2006.01) |

(52) U.S. Cl.
CPC ..... *D10B 2331/10* (2013.01); *D10B 2401/13* (2013.01); *D10B 2401/16* (2013.01); *D10B 2501/02* (2013.01); *D10B 2501/021* (2013.01); *D10B 2501/04* (2013.01)

Long Underwear

Short Underwear

Sleeveless Underwear

Underwear Integrated with Brassiere

Siamese Underwear

METHOD OF MANUFACTURING AND APPLICATION OF BODY SMOOTHING KNITTED UNDERWEAR CAPABLE OF BEING USED AS OUTERWEAR

CROSS REFERENCE TO RELATED APPLICATIONS

This application is based upon and claims priority to Chinese Patent Application No. 201811503483.1, filed on Dec. 10, 2018, the entire contents of which are incorporated herein by reference.

TECHNICAL FIELD

The present invention relates to the technical field of textiles, in particular to a method of manufacturing and an application of body smoothing knitted underwear capable of being used as an outerwear.

BACKGROUND

With increase in quality of life to a certain extent, people's functional requirements for underwear also increase correspondingly. Underwear is not only required to have basic functions of protection and body heat preservation, but is also required to have body beautification functions. Most of the "shapewear", "corset" and "corsetry" in the market squeeze excess fat from various parts of the body to the appropriate or suitable parts by high-elastic or high-strength fabrics. In addition, a wide variety of types are derived by adding the functions such as magnetic sheet massage, anti-bacterial and anti-inflammatory, etc., thereby obtaining a variety of functional under wears. Due to these special effects, the price is also high, but the comfort thereof is to be studied.

In recent years, industry experts in Europe and Japan have constantly proposed body smoothing underwear that is good for human health, such as Vitalize underwear, etc. In addition, the thinness and functionality are also the trend pursued by consumers. Underwear capable of being used as outerwear is even a representation of simplicity and fashion. More and more professionals, in the design and manufacturing of underwear, not only consider the principles of human aesthetics and human engineering, but also focus on health, environmental protection, comfort and functionality. Based on the existing circular knitting machine, the present invention aims to manufacture underwear which can cover body wrinkles and spots, tighten the skin, keep warm and breathability, and is suitable in four seasons by the innovation of raw materials and processes and on the principle of high quality and low price. Secondly, giving the body smoothing function to the underwear further increases the use value of the underwear. Moreover, the underwear is capable of being used as a direct outerwear by choosing new materials and using new processes such as bonding, etc.

SUMMARY

In view of the deficiencies of the prior art, the objective of the present invention is to provide a method for manufacturing lightweight and body smoothing knitted underwear capable of being used as an outerwear by a combined circular knitting device, which includes the following steps:

(1) Yarn Preparation:

covered yarn: winding one of nylon, polyester and polypropylene, ranging from 5 D to 30 D, around a spandex ranging from 10 D to 40 D and used as a core to form a covered yarn;

blended yarn: spinning organic cotton or wool into yarns of 100 S or more for further use, or blending one of the organic cotton and the wool with a chemical fiber to obtain a blended yarn for further use; and composite yarn: making a regenerated cellulose fiber and a chemical fiber into a composite yarn by using a double twisting device;

(2) yarn dyeing: dyeing parts of the yarns as needed;

(3) knitting: knitting the covered yarn, a mixture of the covered yarn and the blended yarn or a mixture of the covered yarn and the composite yarn into a cylinder greige by a knitting machine;

(4) dyeing: dyeing the cylinder greige to obtain a colored cylinder greige, and then performing a finishing processing using a microcapsule finishing agent;

(5) setting: performing a setting on the colored cylinder greige by a special setting device;

(6) cutting and sewing: cutting the colored cylinder greige after being shaped, and then sewing to form body smoothing underwear;

(7) bonding: heating and bonding a patch using a pressurized blancher or/and sewing a patch with a suture in some positions of the body smoothing underwear according to design needs, wherein a low melting point spandex film is used as the patch; and (8) ironing and finishing: ironing the body smoothing underwear after being sewed to keep smooth.

Preferably, in the step (1), the covered yarn is made of a low melting point high-elastic spandex or nylon with a type of FDY/DTY. The covered yarn is one item selected from the group consisting of a single covered yarn, a double covered yarn and an air covered yarn, wherein, the single covered yarn has a twist of 1600-1800 T/M and a draft ratio of 2.7-2.9, the double covered yarn has a twist of 2200-2500 T/M and a draft ratio of 2.5-2.7, and the air covered yarn has draft ratio of 2.7-2.9.

Preferably, in the step (1), the composite yarn is one item selected from the group consisting of a 20D-40D double twisting composite fiber of copper ammonia fiber and polyester, and a 20D-40D double twisting composite fiber of acetate fiber and the polyester.

Preferably, in the step (3), a needle latch with a length from 5 mm to 9 mm is used. A circular knitting machine with a cylinder diameter ranging from 14 to 19 inches and 1248-1920 needles is used to knit a cylindrical cloth body. A circular knitting machine with a cylinder diameter ranging from 4 to 7 inches and 280-400 needles is used to knit the cylindrical sleeves.

Preferably, in the step (3), a pre-shrinked treatment is performed on the cylinder greige obtained by the knitting under vacuum, and heating by steam is performed at a temperature ranged from 80° C. to 90° C. for 20-30 min.

Preferably, in the step (4), a reactive dye is preferred for cotton fiber. An acid dye is preferred for nylon and the wool, and a dyeing pH is adjusted to 5-6, and the dyeing temperature ranges from 80° C. to 95° C.

Preferably, in the step (5), the colored cylinder greige is heated, dried and finished on a special shaping plate. The special shaping plate for a cloth body part has a width ranging from 25 cm to 40 cm and a height ranging from 120 cm to 140 cm, and the special shaping plate for a sleeve part has a width ranging from 9 cm to 12 cm and a height ranging from 60 cm to 100 cm. The steam heating is performed at a temperature ranging from 105° C. to 135° C. for 25-35 s.

Preferably, a step of printing and flocking is further included after the step (5). Specifically, a local part of the colored cylinder greige is decorated with different decorations such as flat printing/3D digital printing, flocking, hand-beading, inlaying lace, etc.

Preferably, in the step (6), one or more selected from the group consisting of DTY 50 D-70 D double nylon, polyester yarn, fiber with a low melting point, and core yarn is used as suture to perform sewing using an overedger.

The present invention also provides an application of the above method for manufacturing underwear, leggings or silk stockings, wherein, the underwear includes various styles such as long underwear, short underwear, sleeved underwear, sleeveless underwear, underwear integrated with brassiere, underwear with detachable brassiere, siamese underwear, and underwaist.

DETAILED DESCRIPTION OF THE EMBODIMENTS

Figure 1:
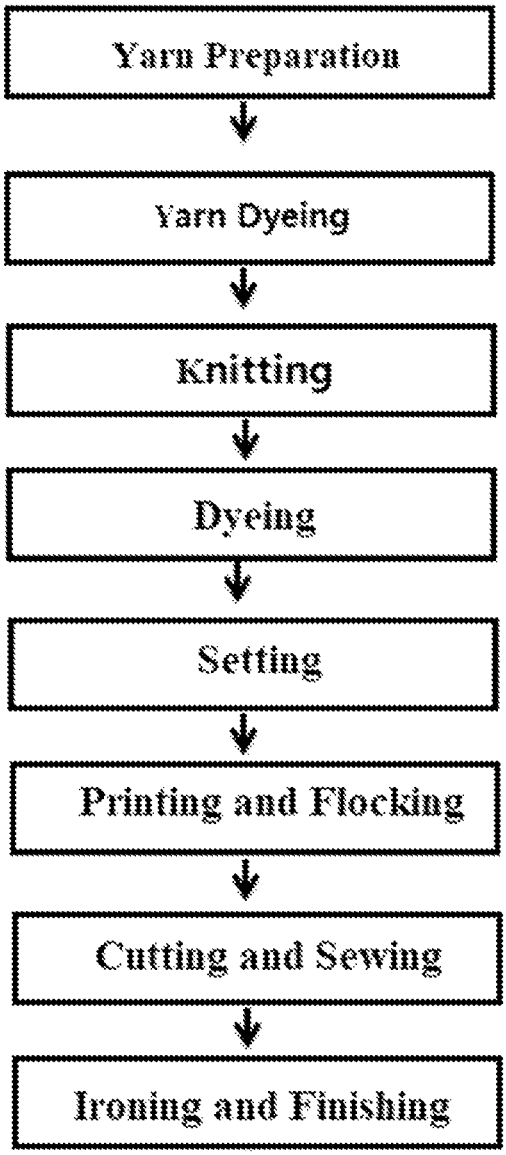
FIG. 1 is a process flow chart of a method of manufacturing of the present invention.

In order to make the objectives, technical solutions and advantages of the present invention clearer, the present invention is further described below in detail with reference to the accompanying drawings and embodiments. It should be understood that the specific embodiments described herein are merely used to explain the present invention and not used to limit the present invention.

Embodiment 1

A method for manufacturing body smoothing knitted underwear capable of being used as an outerwear, specifically includes the following steps:

1. Yarn Preparation

A covered yarn workshop is controlled to have a temperature of 25° C.±3° C., and a relative humidity of 65%±5%. Using the low melting point high-elastic spandex as an inner filament and using the high-strength porous antistatic or antibacterial nylon as an outer filament, covering is performed with a high-speed double-covering machine to form a covered yarn suitable for knitting. The prepared covered yarn has properties such as it gives good feeling when touched with hand, has antistatic property, elastic recovery and durability. The spandex filament is selected from the low melting point special spandex with the type of 15D (other types may also be selected according to needs), and the type of the nylon filament is FDY5/4 (other types may also be selected according to needs). When the covering is performed, the draft ratio is configured to be 2.6 in order to balance the good texture of the knitting and the excellent strength. The twist is configured to be 2350 T/M in order to balance the melting of the spandex during the shaping process and the production stability during the knitting process. The problems like end breakage in the process of yarn covering, and the pile and yarn breakage in the knitting process, are solved by adjusting the state of the device such as the speed of each part, suction, etc.

2. Knitting

A knitting workshop is adjusted to have a temperature of 25° C.±3° C., and a relative humidity of 65%±5%. The required covered yarn is placed in the knitting workshop to be balanced for 7 days. After balancing of the covered yarn, the physical structure of the yarn is more stable, which can effectively reduce the yarn breakage caused during the unwinding process, and is more conducive to knitting.

Four sizes are set according to the process, and the covered yarn is fed into the circular knitting machine to knit the cloth body. The basic size of the Size M is taken as an example: the cylinder knitting machine with a cylinder diameter of 14 inches and 1248 needles was used to make a cloth body into a cylinder greige, the size in the transverse tensile when unloading is configured to have a top width of 125 cm±3 cm, a bottom width of 70 cm±1 cm, and a ribbed hem width of 98 cm±2 cm. The cylinder knitting machine with a cylinder diameter of 4 inches and 400 needles was used to knit a sleeve into a cylinder greige, the size in the transverse tensile when unloading is configured to have a top width of 42 cm±1 cm, a bottom width of 33 cm±1 cm, and a length of 285 cm±3 cm. The problem of the end breakage of the covered yarn is reduced by adjusting the state of the device such as the speed of each part, suction, etc.

A tension controller and an automatic yarn feeder are used on each filament path of the knitting machine. The program of the tension controller is set to act on the automatic yarn feeder to stabilize the automatic yarn feeder at a rotation speed of 300-500 rpm, thereby controlling the yarn feeding speed, and ensuring a uniform texture during the knitting process. In this embodiment, the rotation speed of the automatic yarn feeder is set to 450 rpm, the tension is controlled to 1.5 G, and the pressure effect of the body smoothing is achieved by the buffering and balancing action of the automatic yarn feeder. Different tension values may be used in different parts according to the design needs to ensure the comfort of the body smoothing, and a fabric construction or jacquard structure may be formed according to the design needs.

Since the selected yarn is sensitive to the environment, in the present invention, the knitting is preferably performed at a temperature of 25° C.±3° C. and a relative humidity of 65%±5%. These environmental conditions can ensure the stability of the performance of each part of the yarn to the greatest extent, and reduce the problem caused by the special setting of the twist.

After the woven fabric is unloaded, a heat treatment is performed on the woven cylinder greige under vacuum, and the steaming temperature is precisely controlled at 85° C.±1° C., and the heat treatment is performed for 30 min. Through the heat treatment, the yarn in a relaxed state shrunks, and the residual surface stress gets eliminated, which avoids the damage of the thin product and facilitates the subsequent sewing; meanwhile, it improves the texture definition of the grey cloth and facilitates the color uniformity.

3. Dyeing

The drum-type dyeing device with variable frequency speed regulation is used to dye the pre-shrinked cylinder greige by adding additives and dyes at room temperature to achieve a color that meets the needs of consumers. In order to avoid damage to the fiber elasticity caused by dyeing, in this embodiment, active or acid dyes are used for dyeing at a relatively low temperature. In order to avoid the problem of poor level dyeing, a non-ionic leveling agent is used in an amount of 1.0% by weight of the fabric to achieve a uniform dyeing effect. The pH of the dye is controlled between 5.5 and 6, and the temperature is controlled at 95° C. After dyeing, a color fixing agent in an amount of 5% by weight of the fabric is used to fix the color to enhance the rubbing fastness and washing fastness of the dye. Then, environment friendly collagen and antistatic microcapsule finishing agent are used for the finishing processing, and the amount thereof is 2% by weight of the fabric, so that the fabric not only has antistatic function, but also has the same body beautification functions as cosmetics.

4. Setting

The colored cylinder greige after dyeing is set, dried and shaped on a special device. The cloth body is placed on a shaping plate having a width of 25 cm and a height of 120 cm for heat shaping, and the cloth sleeves are placed on the shaping plate having a width of 9 cm and a height of 70 cm for heat shaping. Steam heating is performed at the heating temperature of 120° C.±1° C. and the treatment time of 20 s. In the shaping process, a process of special microcapsule finish may be performed. Generally, the prepared microcapsule solution is uniformly added to the shaping container along with the shaping steam during the introduction of the shaping steam. After shaping, drying and finishing are performed to ensure that the texture of the fabric is smooth and transparent. The low melting point spandex partially melts to bond together to achieve the body smoothing effect. Moreover, the fabric structure is compact and not prone to detach, which increases the service life of the underwear.

5. Printing and Flocking

According to the design needs, the flat printing, 3D digital printing, flocking, hand-beading, inlaying lace, etc. may be performed on the local part of the cloth body or the sleeves to make the product more suitable for outside wearing. In the case of digital printing, continuous printing is performed with a cylinder as a printing plate, which solves the problem of color marks on both sides of the fabric when the flat printing is performed for a continuous pattern.

6. Cutting and Sewing

After the shaping is completed, the colored cylinder greige is cut by a hot cutting knife to form two areas where the neckline and cuffs are to be sewed according to the design needs.

The modified Pegasus conventional overedger is used, wherein the sewing mode is the DTY70/24 double-strand stretch yarn three-needle four-thread, the size of the cutter is 0.4 cm, and the needle gauge is controlled at 25 needles/inch. The sleeves are first sewed, and then the neckline is inlaid with an elastic band. In particular, a noose is added at the overlap of the stitches for fixing, thereby ensuring the stability of the stitches. Consumers have verified that well integration of the stitches and the elastic fabric cause less deformation after washing, and the elasticity can be well maintained, which gives the body a body smoothing comfort. According to the needs of the design style, decorative materials such as elastic bands, laces, etc. are inlaid on the neckline and the cuffs, so that the underwear is fitter as an outside wearable.

7. Bonding Processing

The single-sided composite knitted fabric single-sided adhesive film is used in the bonding process treatment on the parts which are prone to be damaged under the armpit. The adhesive film cut into a semi-arc lip-like shape is used for bonding in the cloth body under the armpit, and reinforcement treatment is performed at a temperature of 175° C. for 20 s by a pressurized blancher to ensure the durability of the body smoothing underwear.

8. Ironing and Finishing

The sewed body smoothing underwear needs to be partially ironed, and the sewed neckline and cuffs are steam heated for ironing at a temperature of 95° C.-100° C., and each part is heated for 10 s-15 s. The cloth body is made of a relatively stable material after specially shaping, which does not need the secondary ironing.

The fabric is placed flat on the ironing table, and is partially and integrally pressed and ironed by the steam electric iron to ensure that the surface of the fabric is smooth, and some scent odors may be added as needed to make the underwear obtain the aroma.

Figure 2A:
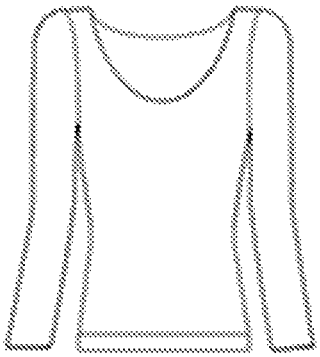
FIGS. 2A-2E are diagrams showing patterns of body smoothing knitted underwear capable of outerwear.
Figure 2B:
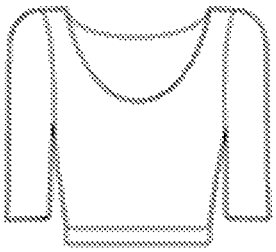
Figure 2C:
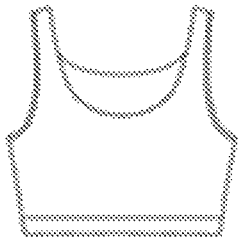
Figure 2D:
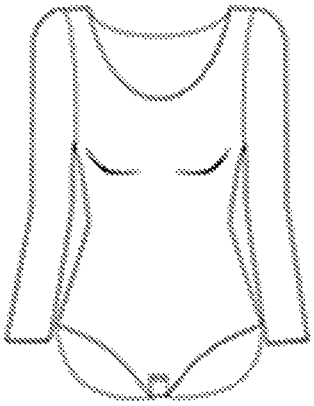
Figure 2E:
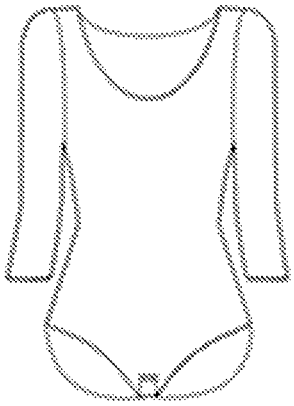

The method of manufacturing described in this embodiment may be used for the production of various underwears including various styles such as long underwear, short underwear, sleeved underwear, sleeveless underwear, underwear integrated with brassiere, underwear with detachable brassiere, siamese underwear, and underwaist as shown in FIGS. 2A-2E. The underwear produced is soft, comfortable, breathable and warm, and has modest elasticity and the body smoothing function, which can tighten the skin. It is beautiful and elegant, and suitable for outside wearing as well.

Embodiment 2

A method for manufacturing body smoothing knitted underwear capable of outerwear, specifically includes the following steps:

1. Yarn Preparation

Covered Yarn Preparation

A covered yarn workshop is controlled to have a temperature of 25° C.±3° C., and a relative humidity of 65%±5%. Using the alkali-resistant low melting point spandex as an inner filament, and using the nylon as an outer filament, covering is performed with a high-speed double-covering machine to form a covered yarn suitable for knitting. The nylon filament and the spandex filament are covered by using an air-covered yarn machine into a covered yarn suitable for knitting. Wherein, the spandex filament is selected from the alkali-resistant low melting point spandex with the type of 20 D (other types may also be selected according to needs), and the type of the nylon filament is DTY20/20 (other types may also be selected according to needs). When the covering is performed, the draft ratio is 2.7. Two air-covered yarns are prepared, which are black yarn and dyeable white yarn, respectively.

Cotton Yarn Preparation

The high-count cotton of 80 S or above, or the blended yarn of high-count cotton and chemical fiber, is treated by the process such as singeing, mercerizing, etching, etc., so that the strip of the yarn is uniform and has features such as less hairiness, etc. Knitting is used to ensure that the fabric is smooth and fine. In this embodiment, the organic cotton 120 S/1 (other types may also be selected according to needs) is selected to be prepared into an S twisted cotton yarn and a Z twisted cotton yarn suitable for knitting for the subsequent use.

2. Yarn Dyeing

The cotton yarn is dyed with a reactive dye in a cheese dyeing machine (other types of dyes may also be selected according to needs), followed by waxing. This step is used to dye organic cotton when producing black or dark underwear, as for producing light-colored underwear, white knitted cotton is used to knit directly.

2. Knitting

A knitting workshop is adjusted to have a temperature of 25° C.±3° C., and a relative humidity of 65%±5%. The required covered yarn and cotton yarn are placed in the knitting workshop to be balanced for 7 days. Four sizes are set according to the process, and the covered yarn is fed into the circular knitting machine to knit the cloth body. The basic size of Size M is taken as an example: the cloth body is fed into the cylinder knitting machine with a cylinder diameter of 16 inches and 1440 needles to make a cylinder greige, the size in the transverse tensile when unloading is configured to have a top width of 120 cm±3 cm, a bottom width of 100 cm±1 cm, and a ribbed hem width of 105 cm±2 cm. The cylinder knitting machine with a cylinder diameter of 5 inches and 360 needles is used to knit the sleeve to make a cylinder greige, the size in the transverse tensile when unloading is configured to have a top width of 44 cm±1 cm, a bottom width of 25 cm±1 cm, and a length of 165 cm±3 cm. The cotton yarn 120 S/1 and the covered yarn 2020/20 are plated and put into the device on each filament path. The black cotton yarn is matched with the black covered yarn, the white cotton yarn is matched with the white covered yarn, and the white cotton yarn may be matched with the black covered yarn as well. The phenomenon of yarn turning over is effectively solved by adjusting the state of the device, such as the speed of each part, suction, etc. A tension controller and an automatic yarn feeder are used on each filament path of the knitting machine. The rotation speed of the automatic yarn feeder is set to 400 rpm, the tension is controlled at 1.0 G, and the pressure effect of the body smoothing is achieved by the buffering and balancing action of the automatic yarn feeder.

After the woven fabric is unloaded, a heat treatment is performed on the cylinder gray cloth under vacuum, and the steaming temperature is precisely controlled at 80° C.±1° C., and the heat treatment is performed for 25 min. Through the heat treatment, the covered yarn in a relaxed state is accurately shrunken, the residual surface stress is eliminated, which improves the resilience, makes the texture of the fabric clear, and improves the uniformity of dyeing in the subsequent process.

4. Dyeing

An overflow drawer dyeing device with variable frequency speed regulation is used to dye the pre-shrunk cylinder greige by adding additives and dyes at room temperature to achieve a color that meets the needs of consumers. The weak acid dye and the direct cross-linking dye are in the same bath for dyeing at a temperature of 90° C., and the pH during the dyeing is controlled between 6 and 6.5. In order to avoid the problem of poor level dyeing, a non-ionic leveling agent is used in an amount of 1.0% by weight of the fabric to achieve a uniform dyeing effect. After dyeing, a color fixing agent in an amount of 4% by weight of the fabric is used to fix the color to enhance the rubbing fastness and washing fastness of the dye. Then, environment friendly aloe humectant and antistatic microcapsule finishing agent in an amount of 2% by weight of the fabric are used for the finishing processing, so that the fabric not only has antistatic function, but also has the same body beautification functions as cosmetics. The black greige used only needs the finishing processing without the necessity of dyeing.

5. Setting

The colored cylinder greige after dyeing is set, dried and shaped on a special device. The cloth body is placed on a setting plate having a width of 35 cm and a height of 130 cm for heating, and the sleeves are placed on the setting plate having a width of 11 cm and a height of 80 cm for heating. Steam temperature used is 115° C.±1, and the treatment time is 20 s. Then, drying and shaping are performed to ensure that the texture of the fabric is smooth and transparent. The low melting point spandex partially melts for bonding together to achieve the body smoothing effect, moreover, the fabric structure is compact and not prone to detach, which increases the service life in use by consumers.

6. Cutting and Sewing

After the setting is completed, the colored cylinder greige is cut by a hot cutting knife to form two areas where the neckline and cuffs are to be sewed according to the design needs. The modified Pegasus conventional overedger is used, the sewing mode is the DTY50/24 double-strand stretch yarn three-needle four-thread, the size of the cutter is 0.5 cm, and the needle gauge is controlled at 28 needles/inch. The sleeves are first sewed, and then the neckline is inlaid with an elastic band. In particular, a noose is added at the overlap of the stitches for fixing, thereby ensuring the stability of the stitches.

7. Bonding Processing

In the inner side of the front of the cloth body, a double-sided spandex point-shape adhesive film is used to bond the inner lining having the bra cup shape, and the material of the inner lining is preferred to be the same fabric as the cloth body (other types of fabrics may also be selected according to needs). The pressurized blancher is used for secondary fixing treatment at a temperature of 135° C. for 25 s to ensure the durability of the body smoothing underwear. The bonded inner lining may be installed with a detachable sponge bra cup, or a bonding process may be selected as needed. The bonded part is smoother, which can replace the traditional sewing process. In the present invention, a special point-shape adhesive film and a low melting point spandex adhesive film are used for bonding to form interlayer inside the underwear, and the detachable sponge bra cup can be attached to the interlayer, or the bra cup can be directly bonded to the underwear, so that the traditional underwear is optimized and combined with the bra. The low melting point spandex adhesive film melts after being heated, and is integrated with the covered yarn used for knitting. The bonded part is very durable, and some parts where the stress concentration occurs may be subjected to the secondary fixing treatment by sewing.

8. Ironing and Finishing

The sewed body smoothing underwear needs to be partially ironed, and the sewed neckline and cuffs are steam heated and ironed at a temperature of 90° C., and each part is steam heated and ironed for 10 s. The cloth body is made of a relatively stable material after specially setting, which does not need the secondary ironing.

Embodiment 3

1. Yarn Preparation

Covered Yarn Preparation

A covered yarn workshop is controlled to have a temperature of 25° C.±3° C., and a relative humidity of 65%±5%. The nylon filament and the spandex filament are covered by using an air-covered yarn machine into a covered yarn suitable for knitting. Wherein, the spandex filament is selected from the alkali-resistant low melting point spandex with the type of 30 D (other types may also be selected according to needs), the type of the nylon filament is DTY15/7 (other types may also be selected according to needs), and the draft ratio is 2.6.

Blended Yarn Preparation

The worsted wool of 100 S or above or wool blended yarn is treated by descaling to ensure close fitting and comfort. The regenerated cellulose fiber of 40 D or below and nylon, polyester or polypropylene with the same or different specifications may also be used to make a composite yarn on a double twisting machine or a covered yarn machine. The strength of the regenerated cellulose fiber is relatively low, and the characteristics of the two yarns after compounding the regenerated cellulose fiber with the chemical fiber can be effectively exerted.

In this embodiment, the worsted shrink-proof merino wool nylon 7525 blended yarn 110 S/1 (other models can also be selected according to needs) is selected to be prepared into an S twisted cotton yarn and a Z twisted cotton yarn suitable for knitting for the subsequent process.

2. Knitting

A knitting yarn workshop is controlled to have a temperature of 25° C.±3° C., and a relative humidity of 65%±5%. The required covered yarn and cotton yarn are placed in the knitting workshop to be balanced for 7 days. Four sizes are set according to the process, and the covered yarn is fed into the circular knitting machine to knit the cloth body. The basic size of Size M is taken as an example, and the covered yarn is fed to knit the cloth body: the cylinder knitting machine with an cylinder diameter of 15 inches and 1344 needles is used to make a cylinder greige, the side in the transverse tensile when unloading is configured to have a top width of 110 cm±3 cm, a bottom width of 93 cm±1 cm, and a ribbed hem width of 97 cm±2 cm. The cylinder knitting machine with an cylinder diameter of 5 inches and 360 needles is used to knit the sleeve to form a cylinder greige, the size in the transverse tensile when unloading is configured to have a top width of 42 cm±1 cm, a bottom width of 23 cm±1 cm, and a length of 155 cm±3 cm. The wool blended yarn 110 S/1 and the covered yarn 3015/7 are plated and put into the device on each filament path.

The phenomenon of yarn turning over is effectively solved by adjusting the state of the device, such as the speed of each part, suction, etc. A tension controller and an automatic yarn feeder are used on each filament path of the knitting machine. The rotation speed of the automatic yarn feeder is set to 400 rpm, the tension is controlled at 1.0 G, and the pressure effect of the body smoothing is achieved by the buffering and balancing action of the automatic yarn feeder.

After woven fabric is unloaded, a heat treatment is performed on the cylinder gray cloth under vacuum, and the steaming temperature is 80° C.±1° C., and the treatment is performed for 25 min. Through the heat treatment, the covered yarn in a relaxed state is accurately shrunken, the residual surface stress is eliminated, which improves the resilience, makes the texture of the fabric clear, and improves the uniformity of dyeing in the subsequent process.

3. Dyeing

A top paddle dyeing device with variable frequency speed regulation is used to dye the pre-shrinked cylinder greige by adding additives and dyes at room temperature to achieve a color that meets the needs of consumers. The acid dye is used for dyeing at a relatively low temperature, the pH during the dyeing is controlled between 5.5 and 6, and the temperature is 95° C. In order to avoid the problem of poor level dyeing, a non-ionic leveling agent is used in an amount of 1.0% by weight of the fabric to achieve a uniform dyeing effect. After dyeing, a color fixing agent in an amount of 5% by weight of the fabric is used to fix the color to enhance the rubbing fastness and washing fastness of the dye. Then a finishing processing is performed, environment friendly antibacterial agent and antistatic microcapsule finishing agent in an amount of 2% by weight of the fabric are used for the finishing processing, so that the fabric not only has antistatic function, but also has the same body beautification functions as cosmetics.

4. Setting

The colored cylinder greige after dyeing is set, dried and shaped on a special device. The cloth body is placed on a setting plate having a width of 30 cm and a height of 130 cm for heat setting, and the sleeves are placed on the setting plate having a width of 11 cm and a height of 75 cm for heat setting. Steam heating is performed at the heating temperature of 118° C.±1° C. and the treatment time of 20 s. Then, drying and shaping are performed. The low melting point spandex partially melts for bonding together to achieve the body smoothing effect, moreover, the fabric structure is compact and not prone to detach, which increases the service life of the underwear.

5. Printing and Flocking

According to the design needs, the flat printing, 3D digital printing, flocking, hand-beading, inlaying lace, etc. may be performed on the local part of the cloth body or the sleeves to make the product more suitable for outside wearing. In the case of digital printing, continuous printing is performed with a cylinder as a printing plate, which solves the problem of color marks on both sides of the fabric when the flat printing is performed for a continuous pattern.

6. Cutting and Sewing

After the setting is completed, the colored cylinder greige is cut by a hot cutting knife to form two areas where the neckline and cuffs are to be sewed according to the design needs.

The modified Pegasus conventional overedger is used, the sewing mode is the DTY50/24 double-strand stretch yarn three-needle four-thread, the size of the cutter is 0.5 cm, and the needle gauge is controlled at 28 needles/inch. The sleeves are first sewed, and then the neckline is inlaid with an elastic band. In particular, a noose is added at the overlap of the stitches for fixing, thereby ensuring the stability of the stitches. Consumers have verified that well integration of the stitches and the fabric causes less deformation after the underwear is washed, and the elasticity can be well maintained, which gives the body a body smoothing comfort.

7. Ironing and Finishing

The sewed body smoothing underwear needs to be partially ironed, and only the sewed neckline and cuffs are steam heated and ironed at a temperature of 90° C., and each part is heated for 10 s. The cloth body is made of a relatively stable material after specially shaping, which does not need the secondary ironing.

The underwear produced by the above method is soft and comfortable, and the Australian long wool is added to keep it warm. It has modest elasticity and body smoothing function, which can tighten the skin, and is beautiful and elegant, suitable for outside wearing.

The above descriptions are only the preferred embodiments of the present invention, and are not intended to limit the present invention. Any modifications, equivalent replacements and improvements made within the spirit and principles of the present invention shall be included in the scope of protection of the present invention.

What is claimed is:

1. A method of manufacturing a body smoothing knitted underwear capable of being used as an outerwear, comprising the following steps:

1) yarn preparation, comprising:

preparing a covered yarn by winding nylon having a thickness ranging from 5 D to 30 D, around a spandex core having a thickness ranging from 10 D to 40 D to form a covered yarn; wherein the spandex core is made of a low-melting-point high-elastic spandex, and the nylon is a type of fully drawn yarn (FDY) or drawn textured yarn (DTY); the covered yarn is one item selected from the group consisting of a single covered yarn, a double covered yarn and an air-covered yarn, wherein, the single covered yarn has a twist of 1600-1800 T/M and a draft ratio of 2.7-2.9, the double covered yarn has a twist of 2200-2500 T/M and a draft ratio of 2.5-2.7, and the air-covered yarn has draft ratio of 2.7-2.9;

preparing a blended yarn by blending one of organic cotton and wool with a chemical fiber to obtain the blended yarn; and preparing a composite yarn by making a regenerated cellulose fiber and a chemical fiber into a composite yarn by using a double twisting device; wherein the composite yarn is one item selected from the group consisting of a 20D-40D double twisted composite yarn made of copper ammonia fiber and polyester, and a 20D-40D double twisted composite yarn made of acetate fiber and the polyester;

2) performing yarn dyeing by dyeing parts of the covered yarn, the blended yarn or the composite yarn;

3) knitting, comprising knitting the covered yarn with the blended yarn or the covered yarn with the composite yarn into a cylindrical cloth body and a cylindrical sleeve of a cylinder greige; wherein after the knitting, a pre-shrinking treatment is performed on the cylinder greige under vacuum, and a steam heating is performed at a temperature ranging from 80° C. to 90° C. for 20-30 min; the cylindrical cloth body is knitted using a needle latch with a size ranging from 5 mm to 9 mm and a knitting machine with a cylinder diameter of 14 to 19 inches and 1248-1920 needles, and the cylindrical sleeve is knitted using a circular knitting machine with a cylinder diameter of 4 to 7 inches and 280-400 needles;

4) dyeing, comprising dyeing the cylinder greige to obtain a colored cylinder greige by using a dyeing agent, and then performing a finishing processing by using a microcapsule finishing agent; wherein the dyeing agent is a reactive dye or an acid dye; the reactive dye is for dyeing of cotton fiber, the acid dye is for dyeing of nylon and wool, a pH of the dyeing agent is 5 to 6, and a temperature of the dyeing agent ranges from 80° C. to 95° C.;

5) setting, comprising performing setting on the colored cylinder greige by a setting device; wherein the colored cylinder greige is heated, dried and finished on a first setting plate and a second setting plate of the setting device, wherein the first setting plate is for the cylindrical cloth body and has a width ranging from 25 cm to 40 cm and a height ranging from 120 cm to 140 cm, and the second setting plate is for the cylindrical sleeve and has a width ranging from 9 cm to 12 cm and a height ranging from 60 cm to 100 cm, and a steam heating is performed at a temperature ranging from 105° C. to 135° C. for 25-35 s;

6) cutting and sewing, comprising cutting the colored cylinder greige after being shaped, and then sewing to forma the body smoothing knitted underwear;

7) bonding, comprising heating and bonding a patch using a pressurized blancher and sewing the patch with a suture in positions of the body smoothing knitted underwear to provide durability to parts of the body smoothing knitted underwear prone to damages or to form an inner lining, wherein a low melting point spandex film is used as the patch; and 8) ironing and finishing, comprising ironing the body smoothing knitted underwear after the patch is sewed to the body smoothing knitted underwear to keep smooth.

2. The method of claim 1, after the step 5, further comprising a step of printing and flocking, wherein a local part of the colored cylinder greige is decorated with decorations, and the decorations comprise one or more of flat printing or 3D digital printing, flocking, hand-beading, and inlaying lace.

3. The method of claim 1, wherein, in the step 6, one or more items selected from the group consisting of DTY50D-70D double-strand nylon, polyester yarn, fiber with a low melting point and core yarn are used as a suture to perform the sewing using a sewing machine.

* * * * *